US010420399B2

(12) United States Patent
Reuben

(10) Patent No.: US 10,420,399 B2
(45) Date of Patent: Sep. 24, 2019

(54) ZIPPER CLOSURE FACILITATOR ASSEMBLY FOR ARTICLES OF APPAREL

(71) Applicant: Ronie Reuben, Town of Mount Royal (CA)

(72) Inventor: Ronie Reuben, Town of Mount Royal (CA)

( * ) Notice: Subject to any disclaimer, the term of this patent is extended or adjusted under 35 U.S.C. 154(b) by 0 days.

(21) Appl. No.: 15/732,445

(22) Filed: Nov. 14, 2017

(65) Prior Publication Data

US 2019/0142115 A1 May 16, 2019

(51) Int. Cl.
*A44B 19/26* (2006.01)
*A47G 25/90* (2006.01)

(52) U.S. Cl.
CPC ..... *A44B 19/262* (2013.01); *A47G 25/902* (2013.01)

(58) Field of Classification Search
CPC ..... A44B 19/262; A47G 25/902
See application file for complete search history.

(56) References Cited

U.S. PATENT DOCUMENTS 3,008,209 A * 11/1961 Kurt ..... A44B 19/04 24/303
3,102,314 A * 9/1963 Alderfer ..... A41F 1/002 24/303
3,681,860 A * 8/1972 Bidegain ..... A43B 3/30 36/112
3,827,019 A * 7/1974 Serbu ..... A41F 1/002 135/117
4,249,267 A * 2/1981 Voss ..... A41F 1/002 2/121
4,399,595 A * 8/1983 Yoon ..... A41F 1/002 24/303
5,604,960 A * 2/1997 Good ..... A41F 1/002 24/303
6,163,883 A * 12/2000 Hong ..... A41D 27/28 2/69
6,170,131 B1 * 1/2001 Shin ..... A41F 1/002 24/303
6,434,801 B2 * 8/2002 Grunberger ..... A41F 1/002 24/114.6
6,880,270 B2 * 4/2005 Prather ..... A41F 1/002 24/303
7,320,158 B2 * 1/2008 Deto ..... A41F 1/002 24/303
7,992,264 B2 * 8/2011 Abadi ..... A41F 1/002 24/3.13
9,549,580 B2 * 1/2017 Horton ..... A41F 1/002
9,572,386 B1 * 2/2017 Scheer ..... A41D 11/00
(Continued)

*Primary Examiner* — Robert Sandy
*Assistant Examiner* — David M Upchurch
(74) *Attorney, Agent, or Firm* — Guy J. Houle; Houle Patent Agency Inc.

(57) ABSTRACT

A zipper closure facilitator assembly for use with articles of apparel to permit a user person with limited arm reach and movement, such has with old age or incapacitated persons, or anyone, ease of access to the slider of the zipper closure. One of the twin bands to which complimentary zipper teeth are secured, has a free short bottom section which is not sewn to the article of apparel but removably attached thereto by magnetic attraction for ease of access to the slider. Closure facilitators using superimposed magnetic strips provides ease of engagement and removal of articles of footwear.

17 Claims, 4 Drawing Sheets

(56) References Cited

U.S. PATENT DOCUMENTS

| | | | | |
|---|---|---|---|---|
| 2002/0095751 | A1* | 7/2002 | Reiter | A41F 1/002 24/303 |
| 2002/0178551 | A1* | 12/2002 | Hsu | A41F 1/002 24/303 |
| 2005/0102802 | A1* | 5/2005 | Sitbon | A41F 1/002 24/303 |
| 2006/0156520 | A1* | 7/2006 | Meranto | A41F 1/002 24/303 |
| 2008/0110004 | A1* | 5/2008 | Franzino | A43C 7/005 24/712.2 |
| 2012/0137476 | A1* | 6/2012 | La Rocca | A44B 19/06 24/405 |
| 2014/0109303 | A1* | 4/2014 | Curtis | A41D 27/201 2/455 |
| 2015/0047105 | A1* | 2/2015 | Fonzo | A41F 1/002 2/265 |
| 2015/0216252 | A1* | 8/2015 | Wiens | A43B 1/0054 36/105 |
| 2015/0305432 | A1* | 10/2015 | Wiens | A43B 1/0054 36/97 |
| 2016/0186789 | A1* | 6/2016 | Nelson | F16B 1/00 24/303 |
| 2016/0331084 | A1* | 11/2016 | Xanthos | A43C 11/008 |
| 2017/0095042 | A1* | 4/2017 | Ressler | A44B 19/382 |
| 2017/0196312 | A1* | 7/2017 | Xanthos | A43B 13/223 |

* cited by examiner

ZIPPER CLOSURE FACILITATOR ASSEMBLY FOR ARTICLES OF APPAREL

FIELD OF THE INVENTION

The present invention relates to zipper closures and particularly to a facilitator which permits a user person with limited arm reach ease of locating and engaging the slider member of a zipper closure when secured to an article of apparel or an article of footwear wherein the slider is located at a hard to reach location wherein the user person needs to bend down to reach the slider and engage it to secure the zipper to an engaged state.

BACKGROUND OF THE INVENTION

Various zipper slider pulling devices are known to engage a zipper slider, or loop secured to the slider, to displace the slider to disengage the zipper attachment. A few of these are described in U.S. Pat. Nos. 5,249,832, 8,079,625 and 9,289,084. Most of these require a hand-held device which a user person manipulates to engage the slider and then pulls to the device to disengage the zipper. These devices are not useful to engage the slider. Further, if these assist devices are lost or become damaged, then the user person cannot disengage the zipper. Still further, zipper sliders are not all fabricated with the same design structure and may not be engageable with the assist device when a different article of apparel is worn by the user person.

There is also a need to provide a closure facilitator for articles of footwear using zippers laces as closures and which are difficult to reach and which require finger dexterity to manipulate or engage and disengage the fastener. There is also a need to overcome the above mentioned disadvantages relating to certain type of closures for articles of footwear.

There is therefore a need to overcome the above mentioned disadvantages of the prior art slider assist devices. It would be of great advantage to permit engagement of a slider in a hard to reach area of an article of apparel without having to resort to a slider pulling device.

SUMMARY OF THE INVENTION

It is a feature of the present invention to provide a zipper closure facilitator assembly for articles of apparel which overcomes the above disadvantages of prior devices and fulfills the required need.

It is a further feature of the present invention to provide a zipper closure facilitator which is incorporated in the pair of elongated bands to which the tracks of meshing teeth are secured.

Another feature of the present invention is to provide a zipper closure facilitator which makes the slider of the zipper easy to be reached and displaced to a comfortable position for engagement to the tracks of meshing teeth.

Another feature of the present invention is to provide a zipper assembly with a closure facilitator and wherein the zipper assembly can be adapted to various types of articles of apparel wherein the facilitator is required for ease of access to the slider.

A still further feature of the present invention is to provide a zipper closure facilitator which permits a user person with limited arm reach and movement, such has with old age or incapacitated person, ease of access to the slider of a zipper closure.

Another feature of the present invention is to provide a magnetic closure facilitator for articles of footwear to facilitate access to the foot closure and facilitate securement of the foot closure.

According to the above features, from a broad aspect, the present invention provides a zipper closure facilitator assembly for articles of apparel. The zipper closure facilitator assembly is comprised by a pair of elongated bands of flexible material each having a track of zipper meshing teeth secured along a longitudinal edge thereof. One of the elongated bands has a first elongated section adapted for permanent securement adjacent a closable opening of an article of apparel. A second short end section is provided for detachable securement adjacent the closable opening of the article of apparel. The short end section has detachable means secured thereto for detachable attachment to a complimentary detachable means secured to the article of apparel adjacent the closable opening to facilitate access to a zipper slider displaceably connected to the track of meshing teeth of the one of the elongated bands for interconnecting and disconnecting the zipper meshing teeth of the pair of elongated bands.

According to a still further broad aspect of the present invention there is provided a magnetic closure facilitator for detachably securing an opening of an article of apparel. The magnetic closure comprises a first longitudinal flexible magnetic band secured to a flexible displaceable material of the article of apparel adjacent a closable opening thereof for at least closing part of the opening. A second magnetic attractive member is secured adjacent the closable opening for magnetic coupling with the first longitudinal magnetic band to close the at least part of the opening.

BRIEF DESCRIPTION OF THE DRAWINGS

A referred embodiment of the present invention and examples thereof is described with reference to the accompanying drawings in which.

DESCRIPTION OF THE PREFERRED EMBODIMENT

Figure 1:
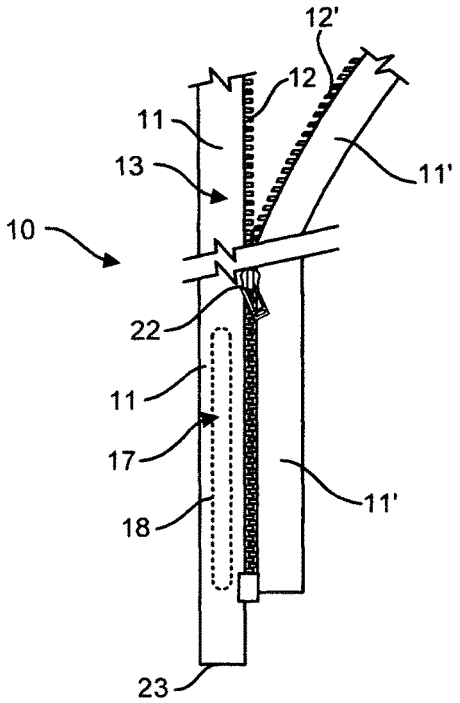
FIG. 1 is a fragmented perspective view of the zipper closure facilitator assembly of the present invention adapted to be secured to articles of apparel.
Figure 2:
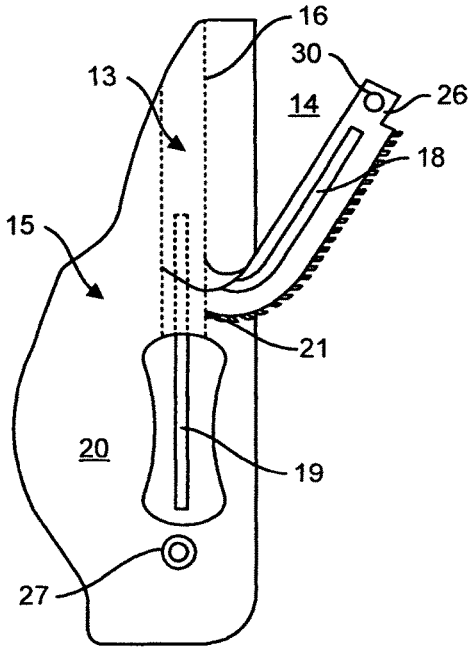
FIG. 2 is a fragmented perspective view showing one of the elongated bands of the zipper closure facilitator assembly of the present invention secured adjacent a frontal opening of a jacket and illustrating the function of the novel feature of the closure facilitator.

Referring to FIGS. 1 and 2 there is shown generally at 10 the construction of the zipper closure facilitator assembly of the present invention. It is comprised of a pair of elongated bands 11 and 11' of a suitable flexible material, as is commonly used in the art in the fabrication of zippers, and along a longitudinal edge of each of which is secured a zipper track 12 and 12' of meshing teeth, respectively. The elongated band 11 has a first elongated section 13 which is adapted to be permanently secured to an article of apparel 15, by stitch seams 16 as shown partly in FIG. 2, and spaced adjacent a closable opening 14 thereof. The article of apparel 15 is a jacket which is better illustrated in FIGS. 3 to 6. The elongated band 11 also has a second free short end section 17 for detachable securement to the article of apparel 15 and in substantial alignment with the first elongated section 13.

The detachable securement means of the free short end section 17 is comprised by a flexible magnetic band 18 secured to the second free short end section 17 on a rear face thereof as shown in FIG. 2 or held captive between opposed fabric sheet forming the free short end section 17. The detachable securement means also comprises a magnetically attractive member, herein a rigid metal element 19 secured behind an outer fabric layer 20 of the article of apparel 15 and held in alignment with the first elongated band 11 by stitch seams 21, as shown in FIG. 2. As shown in FIG. 1, a zipper slider 22 is connected to the zipper track 12 to engage and disengage the teeth of the two tracks 12 and 12' together from the bottom end 23 of the free short end section 17 of the elongated band 11 to close or open access to the opening 14 of the article of apparel 15.

Figure 3:
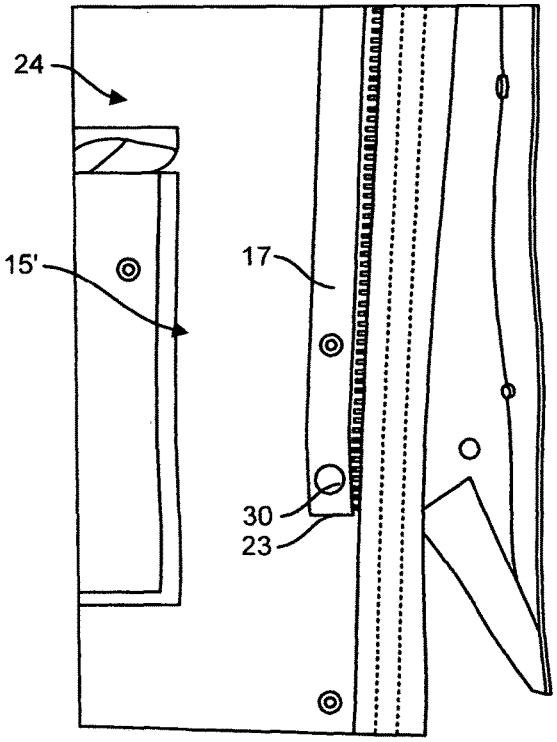
FIG. 3 is a fragmented perspective view showing the elongated band of FIG. 1B having automatically returned to its normal resting non-use position magnetically engaged spaced along an edge of the jacket frontal opening when the zipper is not engaged.

The utility of the detachably secured short end section 17 will now be described with further reference to FIGS. 2 to 6. The detachable free short end section 17 of the elongated zipper band 11 constitutes a facilitator to grab hold of the slider 22 to connect the zipper band 11 and 11' together and particularly so for user persons with limited arm reach and movement, such has with old age or incapacitated persons. It is also a facilitator for any user person and particularly with respect to articles of apparel such as jackets and coats where the zipper is very longs and the slider 22 is usually resting below the waist of a person. FIG. 3 shown a jacket 15' wherein the waist portion 24 of the jacket is substantially above the bottom end 23 of the elongated band 11 of the zipper closure assembly 10. When the jacket 15' is unzipped, as shown in FIG. 3, the magnetic band 18 secured to the free short end section 17 is magnetically attracted to the magnetically attractive member 19 by the magnetic force created between them and the free short end section 17 automatically moves over the element 19 to its position of rest, as illustrated in FIG. 3.

Figure 5:
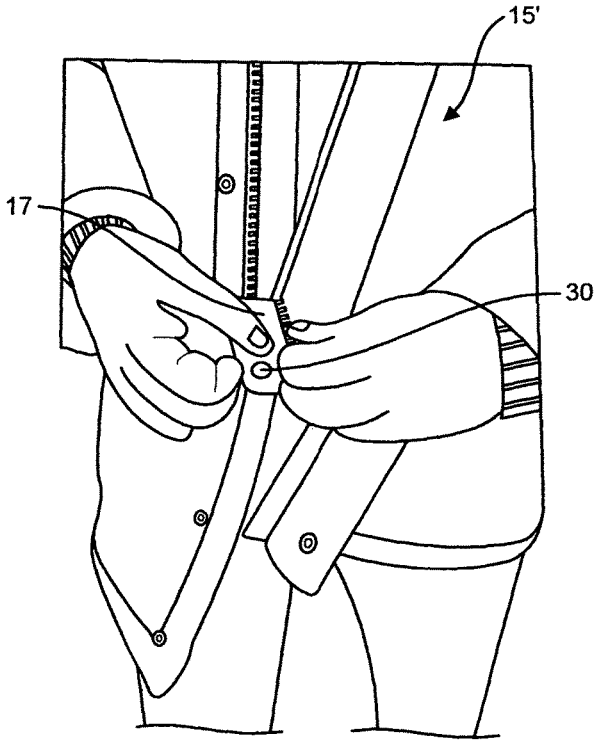
FIG. 5 is a perspective view showing a user person grasping the detachable end section at an elevated position to engage the slider of the zipper teeth of the elongated band having the facilitator to the grasping teeth of the other band secured to the jacket on the other side of the opening.

When there is a need to connect the zipper tracks 12 and 12' together, the user person only needs to reach down with its hand to grasp the free short end section and pull it up to disconnect the magnetic retention force of the magnetic band 18 from the magnetically attractive metal element 19 and to bring the slider 22 in its hands, as shown in FIG. 5, at a position where the end of the other band 11' can be attached to the slider. It is pointed out that the magnetic force of the magnetic band and the magnetically attractive metal element 19 is such as to facilitate the disconnection and provide sufficient magnetic attraction for the free short end section 17 to position itself automatically over the magnetically attractive metal element 19.

Figure 6:
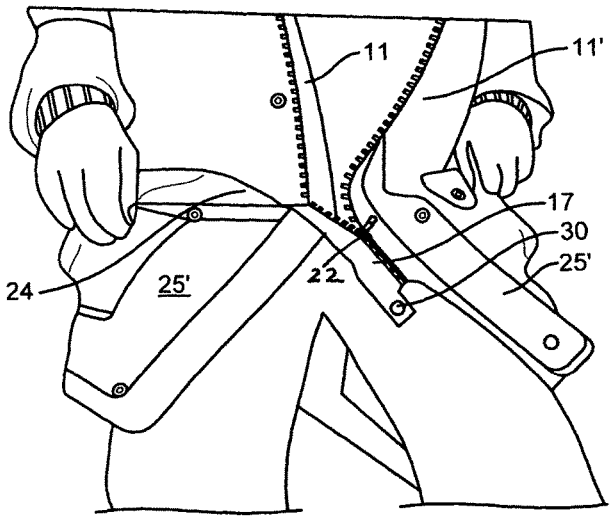
FIG. 6 is a perspective view showing the user person at a sitting position with the zipper partly engaged in a lower section thereof and illustrating a feature of the detachable lower section of the facilitator which cause the jacket to release restrainment against the user person when sitting and to automatically return to its engaged position as illustrated in FIG. 3 when the person stands upright.

Another advantage of the free short end section 17 is shown in FIG. 6 wherein it brings comfort to a user person when in a sitting position with the slider still in an engaged position with the tracks 12 and 12' at a lower region wherein the free short end section 17 is caused to separate from the magnetically attractive member 19 causing the lower parts 25 and 25' of the jacket separate providing leg room to the user person sitting. As soon as the user person stands up the magnetic elements 18 and 19 automatically couple by the magnetic force to reposition the free short end section 17 at its position of rest.

In order to hold the free short end section 17 more rigidly in its position of rest, as shown more clearly in FIG. 2, a button snap connector 26 may be secured to a tab 30 formed at the end of the free short end section 17 for snap engagement with a complimentary connector 27 secured to the article of apparel at a precise position below the magnetically attractive member 19. Instead of a snap connector 26, 27 the connector can be a VELCRO, registered trademark, hook and loop connector or simply a button and slot connector, or any other suitable connector.

It is pointed out that the magnetic elements 18 and 19 can be inverted in that element 18 may be secured to the article of apparel and element 19 secured to the free short end section 17. The magnetically attractive member 19 can be in the form of a rigid steel rod of predetermined diameter sized to provide a predetermined retention force when magnetically coupled to the magnetic element 18. The magnetic element 19 has sufficient stiffness to maintain a straight alignment. Also, the magnetic elements 18 and 19 can be constituted by a magnet having opposed poles at the free ends thereof ant secured with their poles inverted for magnetic attraction and with the magnet in the free short end section 17 being formed by a flexible tape.

Figure 7:
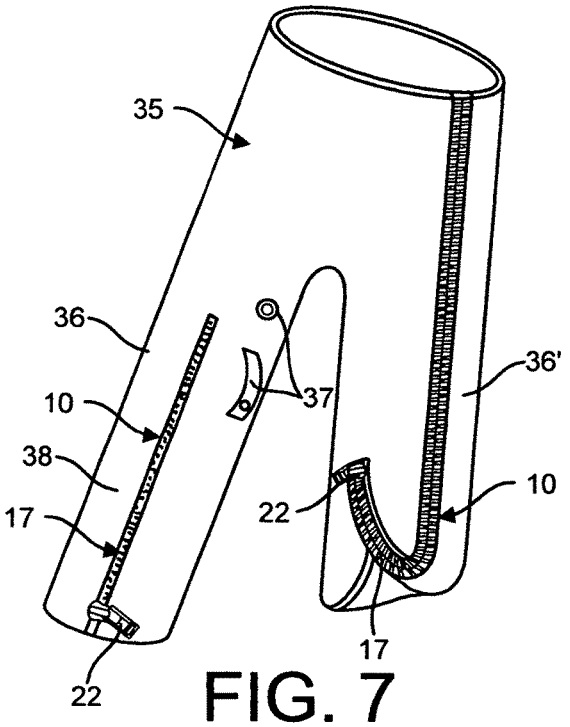
FIG. 7 illustrates another application of the zipper closure facilitator assembly, herein secured to leg portions of a pant.

With reference now to FIG. 7 there is shown a different article of apparel, herein a pair of pants 35 and wherein the zipper closure facilitator assembly 10 is secured all along the sides of each leg portion 36 or to a lower or upper portion thereof to permit ease of removal or for rolling up part of the leg portions. For purpose of illustrating two different applications of the zipper closure facilitator assembly, FIG. 7 illustrates one leg portion 36 with the zipper closure facilitator assembly secured partly up the leg portion and the other leg portion 36' showing the zipper closure facilitator assembly 10 extending the full length of the pant 35. In both cases, the free short end section 17 provides for the user person ease of access of the zipper slider 22. An attachment 37 provided with VELCRO, registered trademark, hook and loop connector, hold the rolled up lower leg portion at an elevated position.

Figure 8:
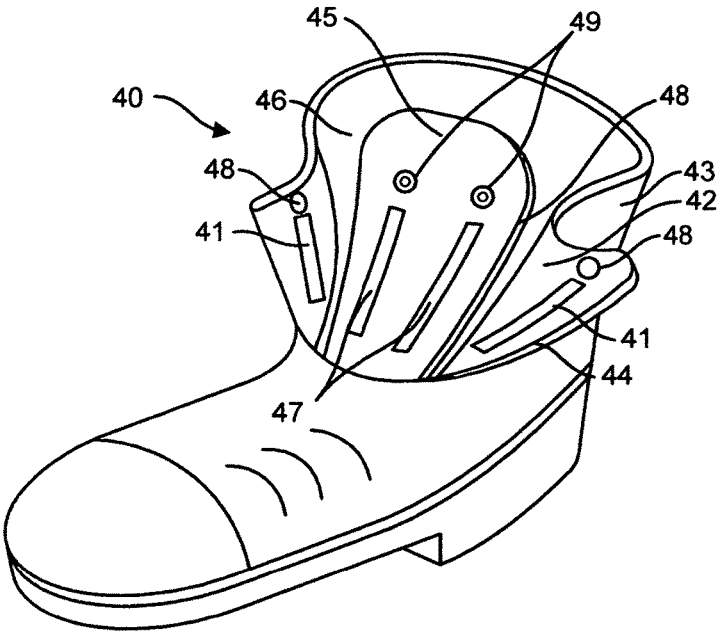
FIG. 8 is a perspective view of an article of footwear illustrating a magnetic closure facilitator for use in securing the footwear opening to the tongue of the article of footwear.

FIG. 8 illustrates the use of magnetic closures for securing an opening of a different type of article of apparel, herein an article of footwear 40. As herein illustrated, a first longitudinal flexible magnetic band or tape 41 is secured to a flexible displaceable material, herein an inner face 42 of an upper 43 of the boot 40 and extends longitudinally adjacent a side edge 44 adjacent a tongue 45 which overlies the opening 46 for mating superimposed magnetic engagement with a second magnetic attractive member 47 secured to opposed sides 48 of the tongue 45. The magnetic elements 41 and 47 are herein shown secured on an outer surface of their respective parts, but these may be secured internally thereof. In order to secure the opening after the foot of a user person is inserted in the opening 46 of the boot 40, the magnetic bands on each side of the opening and attached to the upper 43 are brought over their respective magnetically attractive members 47 secured to opposed sides of the tongue 45 securing the tongue to the upper and over the foot of the wearer person. As herein shown, a snap connector 48 can be secured to each of the upper above the magnetic bands 41 and a complimentary connector 49 secured to the tongue 45 above the magnetically attractive elements 47. To disconnect the attachment, it is only necessary to pull the sides of the upper adjacent the opening 46 outwardly. If snap connectors 48, 49 are used then they are disconnected simultaneously by pulling the sides of the upper 43.

Figure 9:
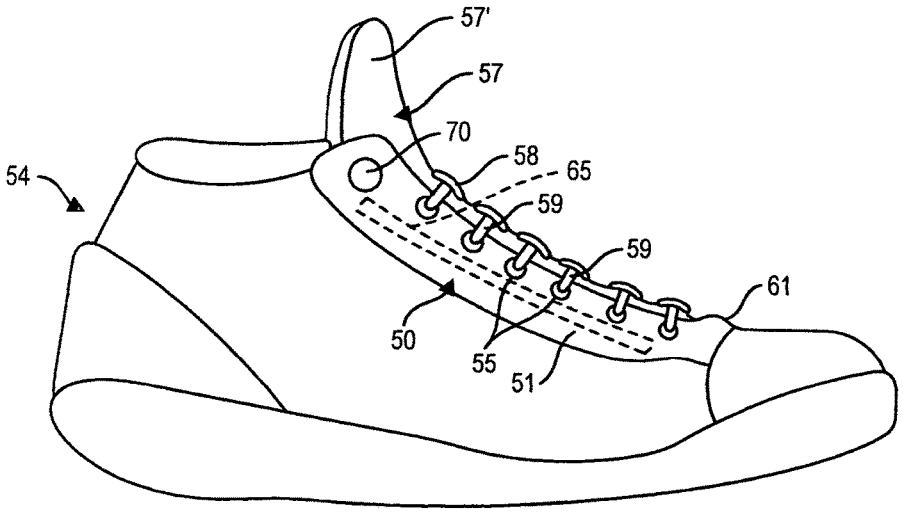
FIG. 9 is a side view of an article of footwear illustrating a further magnetic closure facilitator adapted to a lace securement of a foot opening.
Figure 10A:
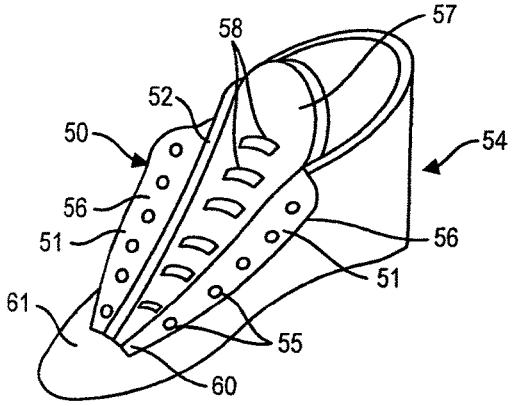
FIGS. 10A and 10B are fragmented perspective views showing the 3 construction and operation of the magnetic closure facilitator of FIG. 9.
Figure 10B:
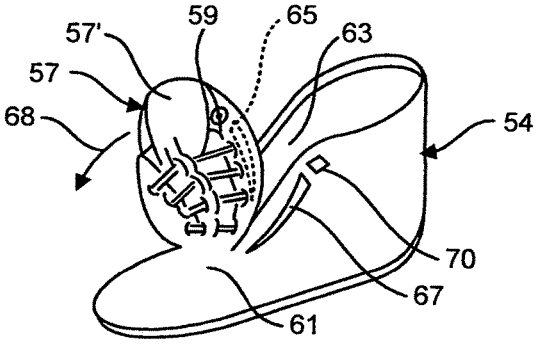
Figure 11:
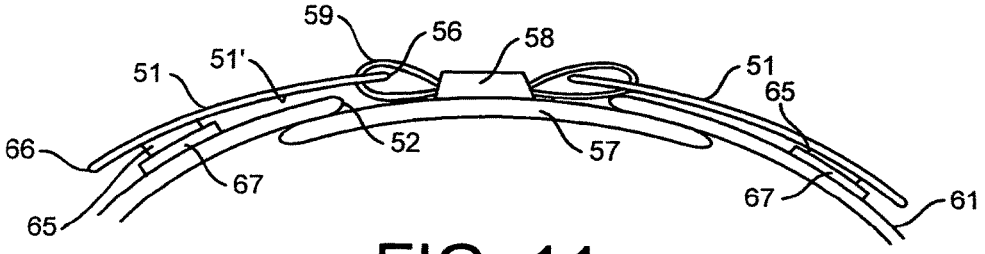
FIG. 11 is a fragmented cross-sectional view illustrating the construction of the magnetic closure facilitator of FIG. 9.

Referring now to FIGS. 9 to 11, there is shown generally at 50 a further embodiment or example of the magnetic closure facilitator. As herein illustrated a flexible displaceable material is in the form of a detachable lace attachment band 51 detachably secured adjacent opposed side edges 52 of the closable frontal opening 53 of the article of footwear 54. The detachable lace attachment bands 51 each have lace eyelets 55, or other form of lace engagement, disposed spaced-apart along an inner edge 56 thereof on a respective one of the opposed sides of the closable frontal opening 53. The lace attachment band 51 overlaps a side portion of a tongue 57 associated with the frontal opening 53 to provide a complete closure of the frontal opening when laces are secured. The tongue 57 has a series of lace receiving loops 58 secured longitudinally thereon and through which the lace 59 extends at its crossing across the tongue 57 and provides a removable connection between the lace attachment bands 51 and the tongue 57. The detachable lace attachment bands 51 are each secured at a lower edge 60 thereof to an upper 61 of the article of footwear 54 at the base of the frontal opening 53.

As can be seen more clearly in FIG. 11, a first longitudinal flexible magnetic band 65 is secured to an inner face 51' of the lace attachment band 51 adjacent an outer edge 66 thereof. A second magnetically attractive member or band 67 is secured, on each side of the frontal opening 53, to the upper 61 of the article of footwear 54 and spaced from the edged 52 of the frontal opening 53 a predetermined distance and extends substantially parallel to their respective side edge 52. The first and second magnetic strips 65 and 67 when disposed in contact provide for removable attachment of the bands 51 to the footwear upper 61. The predetermined location of the magnetic strips 65 and 67 positions the lace attachment bands 51 at substantially precise positions with the bands 51 overlapping the inner edges 52 of the frontal opening 53, as better seen in FIG. 11. The lace 59 is threaded between the eyelets 55 and across the tongue 57 through the loops 58 to secure them together.

With the detachable lace attachment bands 51 secured to the tongue 57 it is now possible to permit quick and easy access to the frontal opening 53 by simply grasping the top part 57' of the tongue 57 and pulling it outwards in the direction of arrow 68, see FIG. 10B, with sufficient force to cause magnetic decoupling of the magnetic strips 65 and 67 permitting the foot of the user person to be liberated from the retaining securement of the tongue and lace attachment with the article of footwear now being worn loosely, such as with a slipper or simply in a fashionable style. To re-attach the tongue the magnetic strips 65 and 67 are brought into contact by pulling the attachment bands 51 over the sides of the frontal opening. Accordingly, access to the frontal opening is provided without having to undo the laces thus facilitating the opening and closure of the frontal opening 53, It is pointed out that the magnetic strength of the magnetic strips 65 and 67 is selected to provide adequate securement of the lace attachment bands 51 to the footwear upper 61. It is also contemplated that the top portions of the magnetic strips are shaped to provide more magnetic retention force. This retention force can also diminish from the top end of the strips to the bottom end by shaping the strips. Additionally, a detachable fastener, such as the snap fastener 70, shown in FIGS. 9 and 10B, may be provided above the strips 65 and 67 to provide increase securement at the top part of the frontal opening 53. Alternatively, patches of loop and hook fasteners may also be used instead of snap fasteners.

Figure 4:
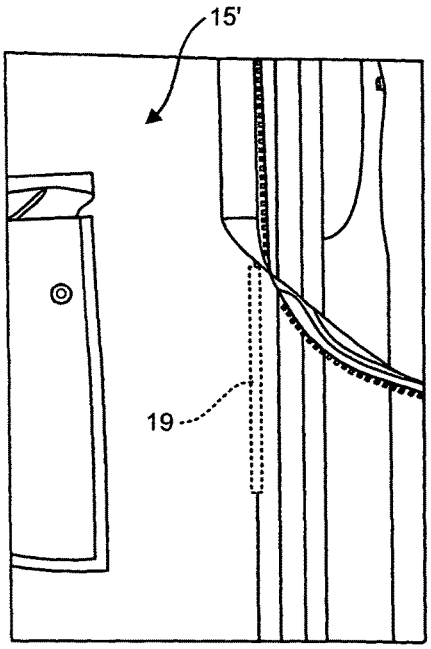
FIG. 4 is a fragmented perspective view similar to FIGS. 2 and 3 showing the short end facilitator section pulled by a user person to magnetically detach it from the magnetically attractive member secured behind the outer fabric layer of the jacket and in alignment with the elongated band.

It is pointed out that flexible magnets are very easy to use as they can be bent, twisted, and coiled or cut with simple instruments such as a knife or scissors. These types of magnets have different strengths for different applications and are low cost. They may also contain a self-adhesive backing when applied or material backing fabric capable of being sewn to connect to the exterior surfaces of the article. They may also be secured internally between fabric pieces, as shown in FIGS. 4 to 6.

It is within the ambit of the present invention to cover all obvious modifications of the preferred embodiment and examples thereof described herein provided such modifications fall within the scope of the appended claims.

The invention claimed is:

1. A zipper closure facilitator assembly for articles of apparel, said zipper closure facilitator assembly comprising pair of elongated bands of flexible material, a track of zipper meshing teeth secured along a longitudinal edge of each said pair of elongated bands, one of said elongated bands having a first elongated section adapted for permanent securement adjacent a closable opening of an article of apparel, and a free second short end section for detachable securement adjacent said closable opening of said article of apparel, said short end section having detachable means secured thereto for detachable attachment to a complimentary detachable means secured to said article of apparel adjacent said closable opening to facilitate access to a zipper slider displaceably connected to said track of meshing teeth of said one of said elongated bands for interconnecting and disconnecting said zipper meshing teeth of said pair of elongated bands.

2. The zipper closure facilitator assembly as claimed in claim 1 wherein said detachable means is a flexible magnetic band, said complimentary detachable means being a magnetic attractive member formed of a material attracted by said flexible magnetic band.

3. The zipper closure facilitator assembly as claimed in claim 2 wherein said flexible magnetic band is a flat magnetic tape, said magnetic attractive member being a rigid metal member, said flat magnetic tape being immovably secured between opposed fabric sheets of said short end section of said elongated band.

4. The zipper closure facilitator assembly as claimed in claim 3 wherein said flat magnetic band is a flexible magnetic tape secured inside said short end section of said elongated band, said rigid metal member being a magnetically attractable straight metal wire immovably secured at a predetermined location adjacent said closable opening in a lower part thereof and in longitudinal alignment with said flat magnetic tape secured to said first elongated section secured to an upper part of said article of apparel adjacent said closable opening of said article of apparel.

5. The zipper closure facilitator assembly as claimed in claim 4 wherein said magnetically attractable straight metal wire has a diameter sized to provide a predetermined retention force when magnetically coupled to said flat magnetic tape through said fabric sheets.

6. The zipper closure facilitator assembly as claimed in claim 1 wherein said article of apparel is one of a jacket, a coat or pants having closeable leg openings.

7. The zipper closure facilitator assembly as claimed in claim 1 wherein said short end section of said one of said elongated bands is provided with a detachable fastening means secured at a free end tab thereof providing additional detachable attachment to said article of apparel to immovably secure said short end section at predetermined position on said article of apparel.

8. The zipper closure facilitator assembly as claimed in claim 7 wherein said detachable fastening means is one of a snap fastener and a button fastener.

9. The zipper closure facilitator assembly as claimed in claim 2 wherein said flexible magnetic band is a flat magnetic tape, said magnetic attractive member being a rigid magnetic member, said flat magnetic band and said rigid magnetic member having unlike magnetic poles facing one another when said short end section is positioned over said rigid magnetic member.

10. A magnetic closure facilitator for detachably securing at least part of an opening of an article of footwear, said magnetic closure comprising a first longitudinal flexible magnetic band secured to a flexible displaceable material of said article of footwear adjacent a longitudinal side edge of a closable frontal opening, a tongue secured at a lower edge of said closable frontal opening through which the foot of a wearer person enters to wear said article of footwear, a lace secured in a trained position on said tongue and permitting free displacement of said tongue from said secured lower edge of said closable frontal opening without detachment of said lace, and a second magnetic attractive member secured to an inner face of said tongue and extending longitudinally adjacent opposed side edges of said tongue for mating superimposed magnetic engagement with said first magnetic attractive member on opposed sides of said closable frontal opening wherein said first and second magnetic attractive members and said flexible magnetic band are totally concealed by said tongue when in said mating superimposed magnetic engagement to close said at least part of said opening.

11. The magnetic closure facilitator as claimed in claim 10 wherein said second magnetic attractive member is a flexible magnetic tape.

12. The magnetic closure facilitator as claimed in claim 10 wherein said first flexible magnetic band and said second magnetic attractive member are secured concealed under an outer sheet material of said tongue and said upper.

13. The magnetic closure facilitator as claimed in claim 10 wherein there is further provided a detachable fastener secured closely spaced above said first longitudinal flexible magnetic band and said second magnetic attractive member, said detachable fasteners adapted to interconnect to one another to form a second attachment between said tongue and said upper on said opposed sides of said closable opening.

14. The magnetic closure facilitator as claimed in claim 13 wherein said detachable fastener is a snap fastener.

15. The magnetic closure facilitator as claimed in claim 10 wherein said flexible displaceable material is a detachable lace attachment band detachably secured adjacent opposed side edges of said closable frontal opening, each said lace attachment bands having lace connectors disposed spaced-apart along an inner edge thereof on a respective one of said opposed sides of said closable opening and overlapping a side portion of a tongue of said article of footwear disposed in displaceable securement behind said closable opening, said tongue having lace receiving loops for removable attachment to a lace trained between said connectors of said lace attachment bands.

16. The magnetic closure facilitator as claimed in claim 15 wherein said first longitudinal flexible magnetic band is secured to an inner face of said lace attachment band adjacent an outer edge thereof, said first and second magnetic attractive members when magnetically coupled together providing for said inner edge of said detachable lace attachment band to extend over opposed side edge portions of said tongue to close said at least part of said opening and providing for the securement of a lace between said connectors and said lace receiving loops of said tongue to interconnect said inner edge of said detachable lace attachment bands together over said opposed side edge portions of said tongue and to form a tongue and lace attachment band closure which is detachably secured by decoupling said first and second flexible magnetic bands to provide quick access to said closable opening with the lace engaging said tongue and lace attachment bands secured together.

17. The magnetic closure facilitator as claimed in claim 15 wherein there is further provided a detachable fastener secured above said first longitudinal flexible magnetic band and said second magnetic attractive member.

* * * * *